US005533769A

United States Patent [19]

Masamitsu

[11] Patent Number: 5,533,769

[45] Date of Patent: Jul. 9, 1996

[54] REORIENTING APPARATUS FOR A CLAMSHELL BUCKET

[75] Inventor: Enoki Masamitsu, San Mateo, Calif.

[73] Assignee: Paceco Corp., San Mateo, Calif.

[21] Appl. No.: 265,574

[22] Filed: Jun. 24, 1994

[51] Int. Cl.[6] ..... B66C 3/02

[52] U.S. Cl. ..... 294/68.23

[58] Field of Search ..... 294/1.1, 67.5, 294/68.23, 86.4, 86.41, 111, 112; 37/461, 184–188; 414/624–626

[56] References Cited

FOREIGN PATENT DOCUMENTS 4251093 9/1992 Japan ..... 294/68.23

127798 1/1960 U.S.S.R. ..... 294/68.23

604797 4/1978 U.S.S.R. ..... 294/68.23

1532518 12/1989 U.S.S.R. ..... 294/68.23

*Primary Examiner*—Johnny D. Cherry

[57] ABSTRACT

A method and apparatus for effecting 90-degree reorientation of a suspended clamshell bucket used for bulk material handling which is accomplished by switching only the attachment points of the bucket hold ropes to the clamshell bucket headblock.

2 Claims, 2 Drawing Sheets

REORIENTING APPARATUS FOR A CLAMSHELL BUCKET

BACKGROUND OF THE INVENTION

1. Field of the Invention

The present Invention relates to improved apparatus and novel methods of operation for bulk material handling clamshell buckets having a pair of bucket scoops with opposed doors. More particularly, the present invention relates to the apparatus and method for reorienting a clamshell bucket 90 degrees with respect to its alternative orientation whereby a bucket can be reoriented for digging within tight spaces such as the holds of ships.

2. Description of the Prior Art

When a clamshell bucket is utilized for scooping bulk material piled in an open area, the operation of the bucket is unrestricted and there is no need to alternate the orientation of the bucket mouth. However, when digging inside the hold of a ship to remove bulk material. It is usually necessary to reorient the bucket 90 degrees In order to dig along all four walls and out of the corners of the holds. The procedure for doing this necessitates detaching the sheaves which are affixed to the base plate of the bucket and rotating them 90 degrees and then reattaching them. In most of the systems in use, it is necessary to rotate both of the internal sheave systems 90 degrees in order for the bucket to rotate correspondingly 90 degrees.

There are some devices on the market specifically designed to accomplish a 90-degree rotation of a clamshell bucket, but these are specialized machines which are expensive and unnecessarily complicated to manufacture.

The present invention is a simplified reorienting apparatus for a clamshell bucket which changes the attachment of the holding ropes to the headblock at different attachment points whereby the clamshell bucket can be rotated 90 degrees without the necessity of disassembly and reassembly of the sheave system which operates the buckets or an expensive apparatus to facilitate the operation.

SUMMARY OF THE INVENTION

The present invention is a reorienting apparatus for a clamshell bucket employing a pair of clamshell bucket scoops having opposed abutting open faces and closed rear walls and supported by a headblock having a fixed sheaves portion of the bucket closing mechanism secured thereto. The movable sheaves portion of the closing mechanism are secured between the pair of scoops, and the headblock is supported by a pair of hold ropes secured to a first pair of attachment points disposed on opposite sides of the headblock. The bucket closing mechanism 1s actuated by a pair of closing ropes reeved between the fixed and movable sheaves. The reorienting apparatus is comprised of a second pair of attachment points on the headblock for the hold ropes disposed on opposite sides of the headblock on an axis perpendicular to the axis which runs through said first pair of attachment points.

OBJECTS OF THE INVENTION

It is therefore an important object of the present invention to provide a new and novel apparatus and method for changing the orientation of a clamshell bucket 90 degrees.

It is another object of the present Invention to provide an inexpensive and simple apparatus and method for reducing the time necessary to reorient a suspended clamshell bucket.

It is a further object of the present invention to provide a means for reorienting a clamshell bucket without the necessity of detaching the Internal sheave blocks.

It is still another object of the present invention to provide a means for reorienting a clamshell bucket by simply a unique reattachment system of the hold ropes.

Other objects and advantages of the present invention will become apparent when the apparatus and methods of the present invention are considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
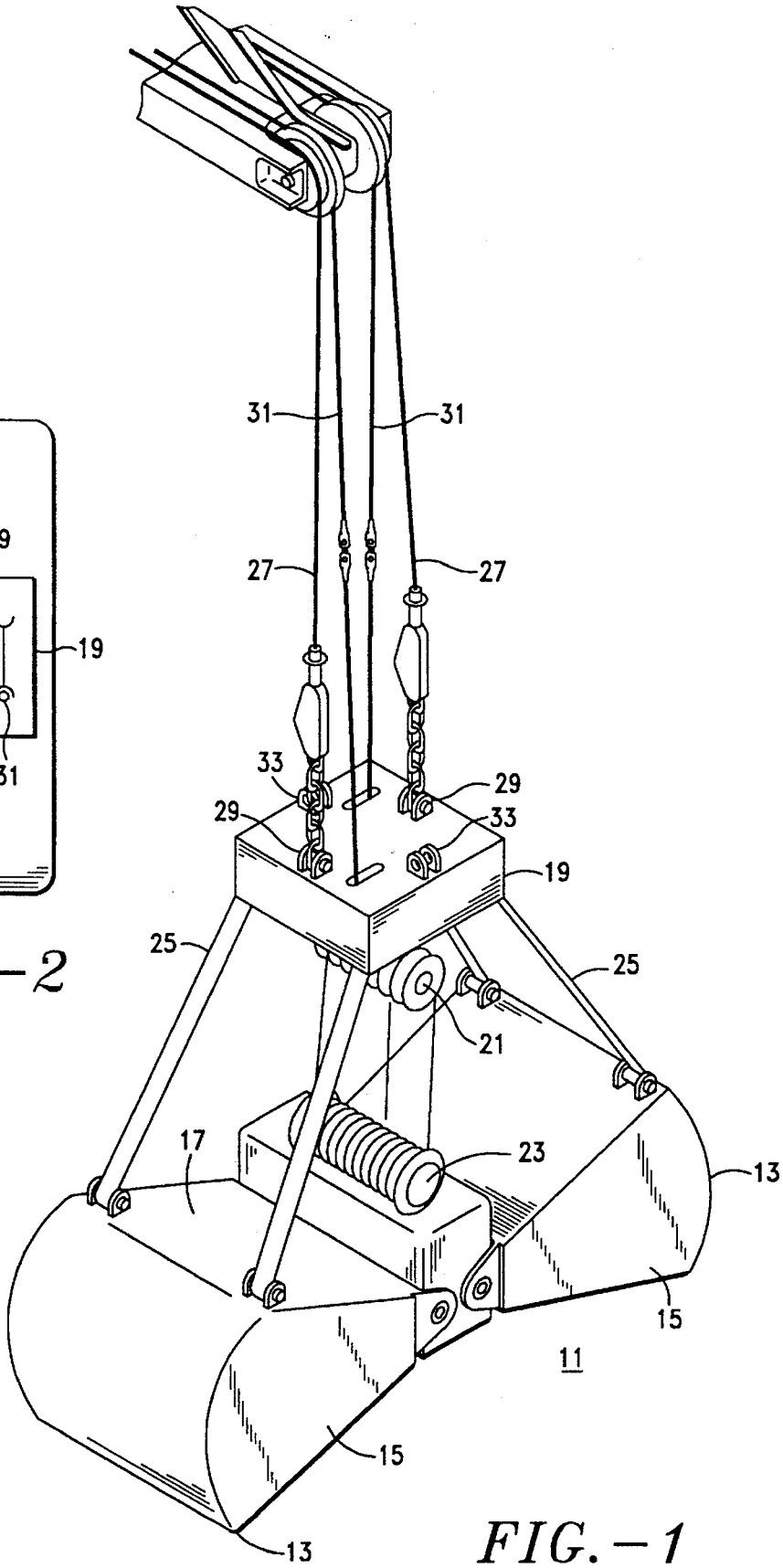
FIG. 1 is a perspective view of a clamshell bucket and its operating mechanism suspended from the end of a Jib crane.

Reference is made to FIG. 1 which illustrates a clamshell bucket 11 in the open position. The reorienting apparatus of the present invention relates primarily to clamshell buckets having a pair of clamshell bucket scoops 13 which in the closed position have opposed abutting open faces, sidewalls 15, and closed rear walls 17. The scoops are supported by a headblock 19 having a fixed sheaves portion 21 of the bucket closing mechanism which is secured thereto. A movable sheaves portion 23 of the closing mechanism is secured between the pair of scoops at the top ends thereof in the closed position. A pair of links 25 is secured between each bucket scoop and the headblock. These links are pivoted at each end at their connections to both the headblock and the bucket scoops.

The headblock 19 is supported in the open position by a pair of hold ropes 27 which are secured to a first pair of attachment points 29 disposed on opposite sides of the headblock. The bucket closing mechanism is actuated by a pair of closing ropes 31 which are reeved between the fixed and movable sheaves 21, 23 whereby as the crane operator pulls on the close ropes, the movable sheave 23 secured to the top ends of the bucket scoops is drawn upward toward the fixed sheaves 21 secured to the headblock. In so doing, the configuration of the attachment points of the top ends of the bucket scoops and the attachment points of the links to the rear of the scoops cause the clamshell bucket to move the opposing open bucket faces towards each other until they dose. If the scoops are resting on a pile of bulk material, they undercut the material due to their weight, as the two scoops close and as the headblock sheaves are moved vertically towards each other by the close ropes, ultimately trapping a quantity of bulk material In the clamshell scoop.

When the bucket is open and at rest on the pile of bulk material, the hold ropes are slack while the close ropes are taken up to close the bucket, but when the bucket is closed and fried with material, either the close or both the close and hold ropes lift the bucket. To open the bucket and dump the material, the hold ropes are held and the close ropes are slackened.

In order to reorient a clamshell bucket of the prior art, it was necessary to detach the unit of sheaves affixed to the headblock and rotate them 90 degrees and reattach them to the headblock, thus reorienting the clamshell bucket. The present Invention allows reorienting the bucket without detaching said sheaves. A second pair of attachment points 33 are provided on the headblock 19 for the hold ropes 27 disposed on opposite sides of the headblock. For purposes of description, they can be described as located on a guide line perpendicular to a reference line which runs through the first set of attachment points. The guide line is located midway between the first pair of attachment points, and the second pair of attachment points are located equidistant on opposite sides of the reference line. The orientation of the attachment points for the hold ropes can also be described as being located or disposed on a guide line lying perpendicular to an axis or reference line lying through the first pair of attachment points. The guide line is located midway between the first pair of attachment points, and the second pair of attachment points is located equidistant on opposite sides of the reference line. This simple but effective reorienting mechanism changes the orientation of the bucket scoop 90 degrees with respect to its prior orientation in the plan view without detaching the sheaves from the headblock.

Figure 2:
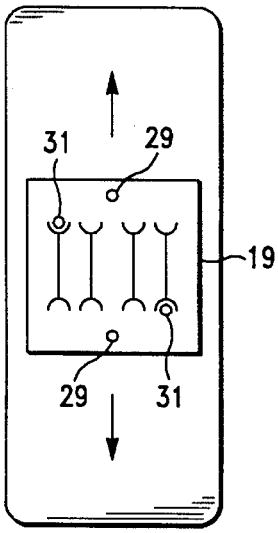
FIG. 2 is a schematic diagram of the reeving arrangement for the clamshell bucket orientation illustrated in FIG. 1.
Figure 4:
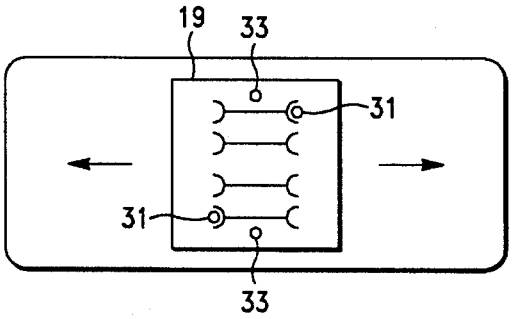
FIG. 4 is a schematic diagram showing the wire rope reeving of the clamshell bucket illustrated in FIG. 3.
Figure 3:
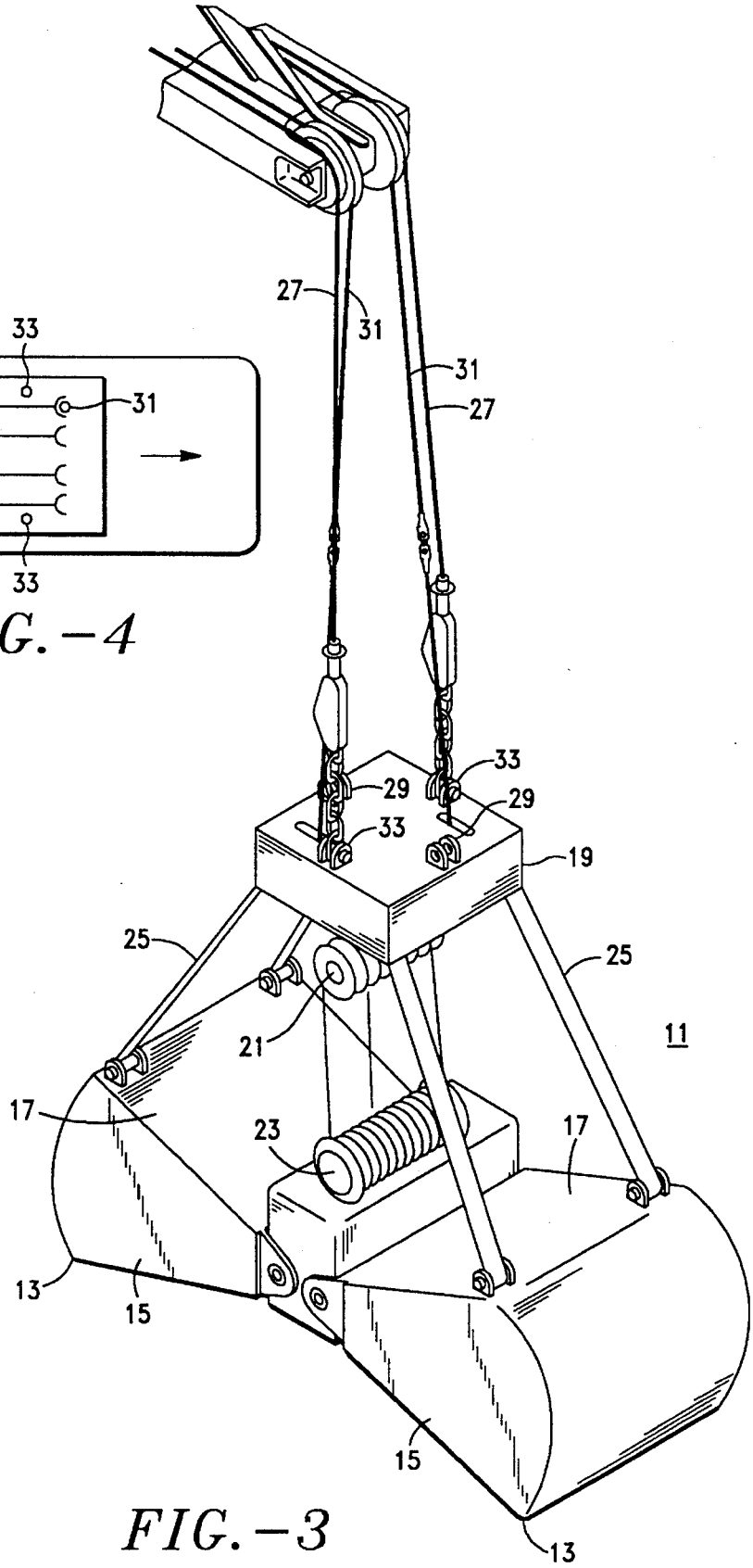
FIG. 3 is a perspective view of a suspended clamshell bucket oriented 90 degrees with respect to the orientation of the clamshell bucket illustrated in FIG. 1.

Reference is made to FIGS. 2 and 4 which are the schematic views showing the orientation of the holding and closing ropes 27, 31 when the orientation is changed 90 degrees. The schematic for the sheave block shows the location of the closing ropes 31 as they contact the first sheave of the block, and the representation for the hold rope shows the attachment points to the headblock which are rotated 90 degrees around the center of the headblock when the reorientation is effected.

Thus, it will be apparent from the foregoing description of the invention in its preferred form that it will fulfill all the objects and advantages attributable thereto. While the apparatus and method of the present invention have been illustrated and described in considerable detail, the invention is not to be limited to such details as have been set forth except as may be necessitated by the appended claims.

We claim:

1. Reorienting apparatus for a clamshell bucket in which the headblock sheaves of the closing mechanism remain in fixed orientation of the headblocks during reorientation of the bucket, comprising a pair of clamshell bucket scoops having open faces and closed rear walls, said scoops being disposed in opposed abutting relation when said bucket is closed, said scoops being pivotably secured to a headblock having a fixed sheaves portion of a bucket closing mechanism secured thereto, the rotational axes of said fixed sheaves lying parallel to a plane formed by the abutting open faces of said scoops when said bucket is closed, a movable sheaves portion of said closing mechanism secured between the pair of scoops, said headblock being suspended by a pair of hold ropes secured to a first pair of attachment points disposed on opposite sides of said headblock and lying on an axis disposed both midlength of and perpendicular to said rotational axes of said fixed sheaves, said bucket closing mechanism being actuated by a pair of closing ropes reeved between said fixed and movable sheaves portions, a second pair of attachment points for said hold ropes formed on said headblock and disposed on opposite sides of said headblock and lying on an axis disposed equidistant between and perpendicular to an axis which runs through said first attachment points, said clamshell bucket scoops being rotated 90 degrees around the vertical axis thereof by detaching said hold ropes from said first pair of attachment points and connecting them to said second pair of attachments points.

2. The method of effecting 90-degree reorientation of a clamshell bucket without changing the orientation of the bucket closing mechanism sheaves with respect to the bucket headblock during reorientation, said bucket including a headblock being supported by a pair of close ropes and by a pair of hold ropes, said hold ropes being secured to said headblock at a first pair of attachment points, said close ropes being reeved into a bucket closing mechanism having fixed and movable sheave portions with parallel axes of rotation, said first pair of attachment points for said hold ropes lying on an axis disposed both midlength and perpendicular to said rotational axes of said sheaves, said method of reorientation comprising providing a second pair of attachment points for said hold ropes on said headblock disposed on an Imaginary guide line lying perpendicular to a reference line lying through the first pair of attachment points, said guide line being located midway between said first pair of attachment points, and said second pair of attachment points being located equidistant on opposite sides of said reference line, and rotating said clamshell bucket 90 degrees about its vertical axis by switching said hold ropes connections from said first pair of attachment points to said second pair of attachment points.

* * * * *